US010692670B2

(12) United States Patent
Fleissner

(10) Patent No.: US 10,692,670 B2
(45) Date of Patent: Jun. 23, 2020

(54) OPERATOR CONTROL APPARATUS FOR A DOMESTIC APPLIANCE COMPRISING A LIGHT GUIDE FOR ILLUMINATING MULTIPLE ZONES OF A FRONT CAP WITH DIFFERENT LIGHT INTENSITIES, DOMESTIC APPLIANCE COMPRISING AN OPERATOR CONTROL APPARATUS OF THIS KIND, AND METHOD FOR OPERATING AN OPERATOR CONTROL APPARATUS

(71) Applicant: BSH Hausgeräte GmbH, Munich (DE)

(72) Inventor: Reinhard Fleissner, Altenmarkt a.d. Alz (DE)

(73) Assignee: BSH Hausgeräte GmbH, Munich (DE)

( * ) Notice: Subject to any disclaimer, the term of this patent is extended or adjusted under 35 U.S.C. 154(b) by 227 days.

(21) Appl. No.: 15/752,599

(22) PCT Filed: Jul. 21, 2016

(86) PCT No.: PCT/EP2016/067356
§ 371 (c)(1),
(2) Date: Feb. 14, 2018

(87) PCT Pub. No.: WO2017/029062
PCT Pub. Date: Feb. 23, 2017

(65) Prior Publication Data

US 2018/0240624 A1 Aug. 23, 2018

(30) Foreign Application Priority Data

Aug. 19, 2015 (DE) ..... 10 2015 215 769

(51) Int. Cl.
*F24C 3/10* (2006.01)
*H01H 19/02* (2006.01)
(Continued)

(52) U.S. Cl.
CPC ..... *H01H 19/025* (2013.01); *F24C 7/082* (2013.01); *H01H 19/14* (2013.01);
(Continued)

(58) Field of Classification Search
CPC .. H01H 19/025; F21V 33/0044; D06F 39/005
See application file for complete search history.

(56) References Cited

U.S. PATENT DOCUMENTS 4,583,151 A * 4/1986 Nagel ..... H01H 19/025 200/316
5,913,414 A * 6/1999 Pollock ..... H01H 19/025 200/316
(Continued)

FOREIGN PATENT DOCUMENTS

CN 102729827 A 10/2012
CN 103745866 A 4/2014
(Continued)

OTHER PUBLICATIONS

National Search Report DE 10 2015 215 769.5 dated Apr. 14, 2016.
International Search Report dated Aug. 30, 2016.

*Primary Examiner* — Andrew J Coughlin
(74) *Attorney, Agent, or Firm* — Michael E. Tschupp; Andre Pallapies; Brandon G. Braun

(57) ABSTRACT

An operator control apparatus for a domestic appliance includes a carrier plate and an operator control element which is rotatably arranged on the carrier plate for setting an operating condition of the domestic appliance. The operator control element includes a front cap having a first transparent region and a second transparent region which is separate from the first transparent region. A light guide extends into the front cap to guide light from a light source such as to illuminate the first transparent region with a first light intensity of the light which is coupled out of the light guide, and to illuminate the second transparent region with a
(Continued)

second light intensity of the light which is coupled out of the light guide, with the second light intensity of the light being different from the first light intensity.

16 Claims, 4 Drawing Sheets

(51) Int. Cl.
*F24C 7/08* (2006.01)
*H01H 19/14* (2006.01)

(52) U.S. Cl.
CPC ..... *H01H 2219/036* (2013.01); *H01H 2219/0621* (2013.01); *H01H 2221/01* (2013.01); *H01H 2231/012* (2013.01)

(56) References Cited

U.S. PATENT DOCUMENTS 6,224,221 B1 * 5/2001 Glienicke ..... G02B 6/0033 116/286
6,356,394 B1 * 3/2002 Glienicke ..... B60Q 3/64 359/641
6,670,567 B1 12/2003 Koseki et al.
2002/0075668 A1 * 6/2002 Dorrie ..... H01H 19/025 362/23.04
2011/0271896 A1 * 11/2011 Fuller ..... D06F 39/005 116/310
2012/0314397 A1 * 12/2012 Nozaki ..... H01H 19/025 362/23.14
2015/0041298 A1 2/2015 Izawa et al.
2015/0162148 A1 6/2015 Murzyn et al.
2018/0045419 A1 * 2/2018 Kim ..... F24C 7/082
2018/0130628 A1 * 5/2018 Udo ..... H01H 23/12

FOREIGN PATENT DOCUMENTS

DE 102007019517 A1 10/2008
DE 102012209998 A1 12/2013
DE 102012220255 A1 5/2014
JP 2008311056 A 12/2008
WO 2004104720 A1 5/2004
WO 2006103160 A1 3/2006

* cited by examiner

OPERATOR CONTROL APPARATUS FOR A DOMESTIC APPLIANCE COMPRISING A LIGHT GUIDE FOR ILLUMINATING MULTIPLE ZONES OF A FRONT CAP WITH DIFFERENT LIGHT INTENSITIES, DOMESTIC APPLIANCE COMPRISING AN OPERATOR CONTROL APPARATUS OF THIS KIND, AND METHOD FOR OPERATING AN OPERATOR CONTROL APPARATUS

CROSS-REFERENCES TO RELATED APPLICATIONS

This application is the U.S. National Stage of International Application No. PCT/EP2016/067356, filed Jul. 21, 2016, which designated the United States and has been published as International Publication No. WO 2017/029062 A1 and which claims the priority of German Patent Application, Serial No. 10 2015 215 769.5, filed Aug. 19, 2015, pursuant to 35 U.S.C. 119(a)-(d).

BACKGROUND OF THE INVENTION

The invention relates to an operator control apparatus for a domestic appliance, comprising a carrier plate on which an operator control element for setting operating conditions of the domestic appliance is arranged in a rotatable manner. The operator control element has a front cap comprising at least one transparent region. Furthermore, the operator control apparatus comprises at least one light guide which extends into the front cap and with which the light from a light source of the operator control apparatus can be guided to the transparent region. Furthermore, the invention also relates to a domestic appliance comprising an operator control apparatus of this kind, and to a method for operating an operator control apparatus.

Operator control apparatuses for domestic appliances are known in a variety embodiments. A specification can be seen in the fact that manually rotatable operator control elements are provided, which are also referred to as operating toggles or rotary knobs. Such operator control elements have a cylindrical front cap which also forms the anterior and circumferential end of the operator control element. This front cap can then be accessed by a user in order to rotate the operator control element.

If these operator control elements also have transparent regions, a specific illumination of these transparent regions can take place using light which is guided to the front cap by means of a light guide. In this way, for example, rotational positions and/or information about operating condition settings can be made visually recognizable, in particular, made visually recognizable on the operator control element and thus also on the front cap itself.

Operator control elements are known in the context, in which the light guide leads into this front cap and is fastened therein in an embedded manner such that a corresponding mounting takes place. As a result, however, the local light emission is restricted and the illumination scenario reduced.

BRIEF SUMMARY OF THE INVENTION

It is the object of the present invention to create an operator control apparatus for a domestic appliance and such a domestic appliance and a method in which a more flexible illumination of a front cap of an operator control element with a light guide is enabled.

This object is achieved by an operator control apparatus and a domestic appliance and a method according to the independent claims.

An operator control apparatus according to the invention for a domestic appliance comprises a carrier plate on which an operator control element for setting operating conditions of the domestic appliance is arranged in a rotatable manner. The operator control element is thus in particular a rotatable operating toggle or a rotary knob. The operator control element has a cap or a front cap comprising at least one transparent region. Furthermore, the operator control apparatus comprises a light guide which extends into the front cap and with which the light from a light source of the operator control apparatus can be guided to the transparent region of the front cap. An essential concept of the invention can be seen in the fact that the front cap has a first transparent region and a second transparent region which is separate from said first transparent region, and the light guide is designed in such a way that the first transparent region can be illuminated with a first light intensity of the light which is coupled out of the light guide and the second transparent region can be illuminated with a second light intensity, which is different from the first light intensity, of the light which is coupled out of the light guide. As a result, locally different regions of the front cap can be individually illuminated with the light which is coupled out, whereby a more flexible and thus, more extensively perceptible visual identification can take place. An intuitively recognizable weighting of the importance of the information is also made visually recognizable with respect to the importance of the information. A user can therefore recognize the setting very easily and quickly or select a setting quickly and easily.

Preferably, the first light intensity is greater than the second light intensity. Then locally limited surface areas of the front cap can be illuminated very brightly and with great intensity and other, particularly larger surface areas of the front cap can be illuminated with a less intense light.

In particular, the different regions of the front cap are illuminated simultaneously with different light intensities such that the aforementioned advantages are especially valuable.

Preferably, the light guide has a first light coupling out region for the coupling out of the light for the illumination of the first transparent region and a second light coupling out region for the coupling out of the light for the illumination of the second transparent region.

In particular, the first light coupling out region and the second light coupling out region are designed in one piece.

Preferably, the light guide extends through an opening in the carrier plate and is in contact with an integrated contact flange on an inner side of the carrier plate. The light guide is also mechanically held to the front cap externally by means of this embodiment. As a result of the specific geometry of the light guide with the contact flange, this fastening can be achieved particularly advantageously in this regard as unwanted inclinations or tipping of the light guide are thus avoided with the contact flange. Thereby, at any time and permanently, the light guided through the light guide can also arrive locally in a very precise manner in the provided respective regions of the front cap. By also integrating this contact flange into the light guide, in this respect, a component-minimized, in particular one-piece light guide with an integrated retaining element, namely the contact flange, can be provided. Production and assembly are simplified in this way. By means of this embodiment for the mounting option of the light guide, an improved light output is also achieved on the front cap and a greater variability enabled with regard to illumination scenarios of the front cap to be generated.

Preferably, it is provided that the light guide is designed separately from the front cap and is arranged with an end of a light output region facing the transparent region at a distance from the transparent region. This is particularly advantageous as the light guide is therefore arranged in a virtually contact-free or contactless manner in relation to this front cap. In this embodiment, in principle it is therefore no longer held by the front cap itself. The aforementioned advantages are further improved in this way. Precisely the embodiment of a maximum light output which can then be guided to the front cap, on the one hand, and a variable depiction of symbol-dependent variables of the illumination intensities, on the other hand, is improved thereby. However, the variability of illumination scenarios can be substantially increased by means of such a spacing of the light guide from the front cap into which the light guide then still extends in some areas. In this context, it is then even possible, depending on the geometry of the light guide, to illuminate some of the many transparent regions of the front cap in a targeted manner and differently to other transparent regions using light emitted from the light guide. In this way, a very high light intensity can be achieved for some transparent regions, and a desired reduced light intensity can then be achieved for others. This also enables a distinction between strong, precise to weak, extensive illumination within a single component, namely the front cap.

Furthermore, parallax problems can also be at least significantly reduced, or where applicable, completely prevented.

Preferably, it is provided that the contact flange is designed completely circumferentially around a longitudinal axis of the light guide. It is particularly designed as a frame or rectangular frame. Preferably, it is rectangular in this regard. A highly uniform arrangement of the light guide on the inner side of the carrier plate is thus achieved. A particularly advantageous prevention of the tipping of the light guide relative to the carrier plate is thus likewise enabled.

Preferably, it is provided that a light guide section extends in the direction of the longitudinal axis of the light guide on both sides of the contact flange. In this context, the light guide section is a section which guides coupled light in a targeted manner. In particular, this embodiment advantageously enables the coupling in scenario to be designed as simply as possible as the light source can be arranged outside the front cap and on a first side of the carrier plate. On the other hand, it also enables only a desired partial section of the light guide, namely a further light guide section, to extend through the opening of the carrier plate and in this context, to extend to the side opposite the first side of the carrier plate. In this way, in addition to the specific fastening and individual guiding of light, the carrier plate can also serve as a separation element between the front cap on the one hand, and the light source and other components, on the other hand. Unwanted light scattering or the like, which might then occur from the light emitted by the light source, can thereby be avoided.

Preferably, it is provided that a first light guide section of the light guide forms an irradiation section and leads to the contact flange. A second light guide section of the light guide forms a radiation section and leads to the contact flange. Both light guide sections therefore end directly on this contact flange, on opposite sides of the contact flange. The second light guide section has the light coupling out regions.

It is particularly advantageous that the design of the first light guide section is geometrically different from the second light guide section. Thus, the coupling in of light, on the one hand, and the defined radiation scenarios, on the other hand, can be achieved in a particularly advantageous manner. Very precise contours, which can be geometrically small, can then serve as coupling in regions or coupling in surfaces on the first light guide section such that the largest possible amount of light can be coupled into the light guide here and yet little installation space is required. On the other hand, however, account can then be taken of the aforementioned advantages that all kinds of coupling out scenarios and thus illumination scenarios are provided for the front cap by the different second light guide section.

With respect to the geometric difference, in particular a difference in the shape and/or in the dimensions can be seen. In particular, the length viewed in the axial direction of the light guide can be different here.

It is advantageously provided that the first light guide section is hollow and, viewed in the direction of the longitudinal axis of the light guide, open on both sides. This first light guide section is therefore virtually tubular in design, whereby it is very sparing in its use of materials and nevertheless has an advantageous coupling in structure.

Preferably, it is provided that the first light guide section has a trapezoidal inner contour on a sectional plane viewed perpendicular to the longitudinal axis. In particular, this trapezoidal inner contour is embodied over the entire length of the first light guide section viewed along the longitudinal axis of the light guide. In this way, highly individual light scenarios can be designed.

Preferably, it is provided that the first light guide section has a trapezoidal outer contour on a sectional plane viewed perpendicular to the longitudinal axis. Thus, the surface area formed between the inner contour and the outer contour is then designed as a trapezoidal frame. Advantageous guiding of the light to this effect in the second light guide section is thereby provided.

Preferably, it is provided that the first light guide section has an outer contour which, viewed in the direction of the longitudinal axis, is conically widened from a coupling in end to the contact flange. By this means, a particularly large amount of light relative to a quite specific geometry of this first light guide section can be guided to the second light guide section.

Preferably, it is provided that in some areas the second light guide section is hollow in design. A complete, hollow embodiment viewed along the longitudinal axis should therefore not be provided here, but only sections thereof. In this way, in turn, on the one hand a very lightweight embodiment of the second light guide section can be facilitated and on the other hand, particularly advantageous and diverse light guide scenarios and illumination scenarios achieved.

Advantageously, it is provided that the second light guide section is closed on a coupling out end facing away from the contact flange and has a coupling out structure. This favors the creation of highly diverse and different illumination scenarios significantly. In particular, account is then namely taken of the aforementioned aspects by means of the individual design of this coupling out structure. In this context, the coupled-out light can then be individually guided to a plurality of different places or transparent regions of the front cap such that here, if applicable, there is a uniform optical appearance simultaneously in different such regions. Likewise, however, it can also be provided that such transparent regions are then illuminated simultaneously but with different light strengths or light intensities.

The coupling out structure comprises the first light coupling out region and the second light coupling out region.

Preferably, the first light coupling out region is a polygonal structure inwardly oriented in the direction of the first light guide section, in particular a pyramid shape. The second light coupling out region is in particular a scattered light zone embodied on a casing side of the, in particular trapezoidal, second light guide section and surrounding the polygonal structure at least in some areas. The scattered light zone is a region designed with a specific surface structure and therefore a specific surface roughness.

By means of such an embodiment, a front cap can be differently backlit in intensity in terms of zones particularly advantageously such that on a front wall of the front cap a plurality of transparent regions is embodied, in particular in a circle with respect to each other, and one region is brightly illuminated and the other regions are less brightly illuminated in relation thereto. This is the case, for example, for an operator control element which is designed for the selection of functions of the domestic appliance. For example, this illumination concept is provided if the light guide is arranged in a 12 o'clock position relative to the rotational position of the front cap.

Preferably, it is provided that a coupling out structure is a polygonal structure inwardly oriented in the direction of the contact flange. In this way, very specific local radiating surfaces or radiating edges can be created which then produce locally specified illumination patterns on the front cap and in this context, transparent regions of the front cap can be individually irradiated.

Preferably, it is provided that the polygonal structure is a pyramid shape. In this way, the aforementioned advantageousness is specified to the effect that the different radiation regions are then also still radiated in a highly uniform and symmetrically oriented manner.

Preferably, it is provided that the second light guide section has a trapezoidal inner contour on a sectional plane viewed perpendicular to the longitudinal axis. This embodiment enables a completely individual light pattern in the coupling out region. In particular, even if a trapezoidal inner contour is embodied in the first light guide section, the light can be guided in the light guide highly uniformly and with minimized loss and a more complex geometry of the light guide for guiding the light is nevertheless enabled, which then enables different diverse radiation scenarios for the creation of illumination scenarios of the front cap.

Preferably, it is provided that the inner contour of the second light guide section tapers, viewed in the direction of the longitudinal axis of the light guide, from the contact flange to a coupling out structure embodied on a coupling out end facing away from the contact flange. In this way, a certain integration or bundling is then enabled in turn, such that in turn there is a focused light supply to the coupling out structure.

Preferably, it is provided that the second light guide section viewed on a sectional plane perpendicular to the longitudinal axis of the light guide also has a trapezoidal outer contour. The advantages which can be obtained in this regard with a geometry compatible with the geometry of the inner contour or an equally designed geometry of the outer contour were already mentioned above for the first light guide section.

In a further advantageous embodiment of a light guide, the first light guide section is T-shaped in design. This enables a quite specific coupling scenario to be achieved and a more complex geometry is already provided in the first light guide section in order to be able to guide the coupled in light to the second light guide section in a specific shape.

In an advantageous embodiment, it is provided that the top of the T-shape, and therefore the horizontal cross bar of the T-shape, is curved.

In particular, the T-shape is embodied in a widening manner from a coupling in end to the contact flange, viewed in the direction of the longitudinal axis of the light guide. The largest possible amount of light can therefore be guided to the second light guide section with the least possible loss. This geometric embodiment of the first light guide section is particularly advantageous when the end of the second light guide section facing the first light guide section is geometrically larger than the first light guide section, in particular, than the coupling in end of the first light guide section. In this way, an extensive dispersion of light can then take place from the first light guide section into the then also larger, practically reverse end of the second light guide section from the first light guide section into the second light guide section.

Preferably, it is provided that at a coupling in end of the T-shape a coupling in surface of a base of the T-shape leads to a coupling in surface of the top of the T-shape and the coupling in surface of the base extends on a plane which is oriented at an angle to a plane on which the coupling in surface of the top extends. These two coupling in surfaces are therefore not oriented on a common plane, whereby in turn individual coupling in scenarios are also already enabled at this coupling in end. On the one hand, this then also favors the guiding of light and on the other hand, the desired coupling out and illumination scenarios achievable thereby.

Preferably, it is provided that the second light guide section has an annular section as a second light coupling out region and a pin which is cylindrical or angular in cross-section, in particular rectangular or triangular, as the first light coupling out region. This is a particularly individual, shape-specific embodiment which quite particularly advantageously enables the achievement of a punctiform illumination of the front cap with the pin, and on the other hand, more extensive illuminations with the annular section.

This is advantageous precisely for operator control elements which are designed for setting an operating parameter, for example, a temperature. Precisely when temperature values are designed as transparent regions on a front wall of the front cap in a radially further inward arc or circle, and marking zones assigned to the values are then designed as transparent regions in a radially larger arc or circle for this purpose on the front wall, a marking zone can be brightly illuminated in a highly focused manner and the associated value radially further inwards illuminated more dimly and/or the adjacent marking zones and associated values illuminated more dimly. Such an operator control element is, for example, a temperature selector.

Preferably, it is provided that the pin extends further in the direction of the longitudinal axis than the annular section. The aforementioned advantages are favored thereby. In particular, this also results in the light intensity in the punctiform illumination which is generated by the pin being greater than in the annular sections with a greater coupling out surface in this regard. Furthermore, as a result of the greater distance between the coupling out surface of the annular section and a transparent region of the front cap to be illuminated, there is a greater light surface or light expansion of the coupled-out light. In particular, the light intensity in the transparent region in the front cap illuminated with the annular section is then also lower as a result.

Preferably, it is provided that the pin tapers from the contact flange to a coupling out end. The light focusing and sharply outlined illumination of a transparent region of the front cap is improved thereby.

Preferably, it is provided that the pin is designed so as to be embedded, in particular with a connecting region which is molded with a cylindrical shape on a casing wall tapering in some areas into a receptacle, in particular at an arc maximum, of the annular section.

It can be provided that a coupling web is molded to the contact flange, in particular perpendicular thereto, for coupling to an adapter part comprising the light source. It is therefore provided that the coupling web extends in particular perpendicular to a plane spanned by the contact flange. By means of such an embodiment, the mechanical connection to an adapter part separate from the carrier plate is favored such that here too a high degree of precision in positioning in relation to each other is obtained. Furthermore, in addition to being fastened to the carrier plate, the light guide is also fastened to the adapter part.

Preferably, it is provided that the light guide is designed in one piece from plastic, in particular PMMA or PC.

It can be provided that the light guide is burnished on the surfaces, at least in the regions to which the light is guided.

It can also be provided that the cap has a circular surface region as a first transparent region and/or a line region as a second transparent region. Thus, it can be provided that such a circular surface area is embodied on a front wall of the, in particular, cylindrical front cap. Preferably, it can be provided that a line area is embodied as a transition between a front wall of the front cap and an adjoining casing wall of the front cap. The line region can, for example, be designed as a full circle.

Preferably, it is provided that the cap on an inner side facing the light guide is embodied from fiber-optic material, at least in some areas. The effect of extensive light scattering can be strengthened hereby. It can also be provided that a print of a front cap is embodied on a front wall and/or a casing wall and that this information is backlit here in connection with transparent regions or the light regions located laterally thereto are visually marked.

In particular, the scatter of the coupled-out light is also dependent on the length of the light guide, in particular, of the second light guide section and therefore of the remaining distance between an inner side of the front cap and a coupling out end of the light guide. This is also further dependent on how the structuring of the coupling out structure is designed.

In the embodiment of the light guide with a cylindrical pin in the second light guide section, in addition to the advantageousness of a very precise coupling out of light with greater intensity already mentioned on an inner side of the front cap, a parallax error can especially be avoided by means of the corresponding greater length compared to the annular section. On the other hand, with the shorter curved region, which represents an annular section, the light can be widely scattered and an inner side of the front cap thus illuminated relatively homogeneously.

In particular, the front cap is the front-end part of the operator control element. In particular, the front cap is designed cylindrically and, on the side facing the carrier plate, it has a cavity open to the carrier plate which is delimited by a front wall and an adjoining casing wall. The front cap can be designed in one piece or in several pieces. It can be printed or in some areas laminated with a film. The front cap may have a base part which is surrounded by a metal ring of the cap in at least some areas.

In particular, the light guide is shaped and designed such that a radiation scenario or coupling out scenario of the light can be generated in which, in particular simultaneously, radiation areas which are geometrically different and/or different in terms of light intensity and/or locally different can be generated such that various transparent regions are also individually irradiated simultaneously.

Furthermore, the invention relates to a method for operating an operator control apparatus of a domestic appliance, comprising a carrier plate on which an operator control element for setting operating conditions of the domestic appliance as a function of the rotation is arranged in a rotatable manner, wherein the operator control element has a front cap comprising at least one transparent region, and comprising a light guide which extends into the front cap and with which the light from a light source of the operator control apparatus is guided to the transparent region. A first transparent region of the front cap is illuminated with a first light intensity of the light which is coupled out of the light guide and a second transparent region of the front cap which is separate from the first transparent region is illuminated with a second light intensity, which is different from the first light intensity, of the light which is coupled out of the light guide.

Advantageous embodiments of the operator control apparatus are to be considered as advantageous embodiments of the method, wherein for this purpose the subject embodiments enable the steps of the method alone or in operative connection.

The directions "in a widthwise direction", "in a vertical direction", "in a downwards direction", "top", "bottom", "front", "reverse", "outside", "inside", etc. for the operator control apparatus and the domestic appliance refer to the state of a domestic appliance for conventional use as intended, in particular comprising a door which is arranged at the front for an observer and the reverse side at the back.

Further features of the invention derive from the claims, the figures and the description of the figures. The aforementioned features and combinations of features in the description, and the features and combinations of features specified hereinafter in the description of the figures and/or shown in the figures alone can be used not only in the specified combination, but also in other combinations or in isolation, without departing from the scope of the invention. Embodiments of the invention which are not explicitly shown and explained in the figures, but which emerge and can be generated from the elucidated embodiments by means of separated combinations of features, are therefore also to be regarded as included and disclosed. Embodiments and combinations of features which therefore do not have all the features of an originally formulated independent claim are also to be regarded as disclosed.

BRIEF DESCRIPTION OF THE DRAWINGS

Exemplary embodiments of the invention are explained in more detail hereinafter with reference to diagrammatic drawings, in which.

DETAILED DESCRIPTION OF EXEMPLARY EMBODIMENTS OF THE PRESENT INVENTION

Figure 1:
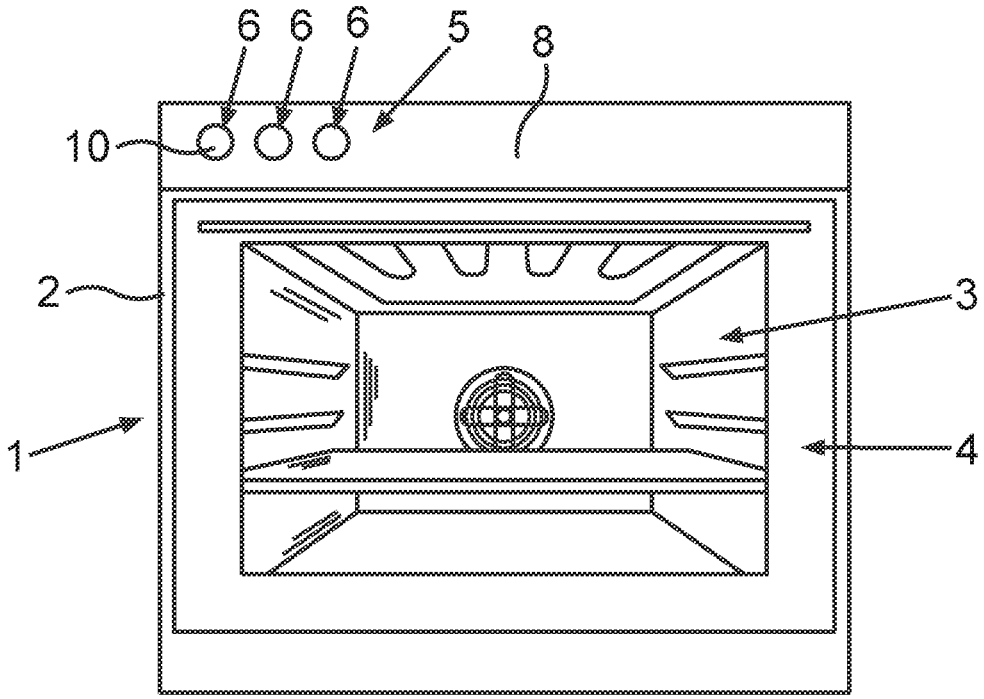
FIG. 1 shows a front view of an exemplary embodiment of a domestic appliance according to the invention for preparing food.

In the figures, identical or functionally identical elements are provided with the same reference characters.

FIG. 1 shows a domestic appliance 1 which is designed for preparing food and is, in particular, a cooking appliance such as an oven. The domestic appliance 1 comprises a housing 2 in which a preparation chamber 3, in particular a cooking chamber, is designed for food. This preparation chamber 3 can be closed at the front by means of a door 4 which can be swiveled around an axis relative to the housing 2 and is arranged on the housing 2. The domestic appliance 1 furthermore comprises an operator control apparatus 5 which has a plurality of operator control elements 6 by way of example. At least one operator control element 6 is an operating toggle or a rotary knob which is rotatable around an axis of rotation perpendicular to the figure plane, whereby the operating conditions of the domestic appliance 1 are set by means of various rotational positions.

Figure 2:
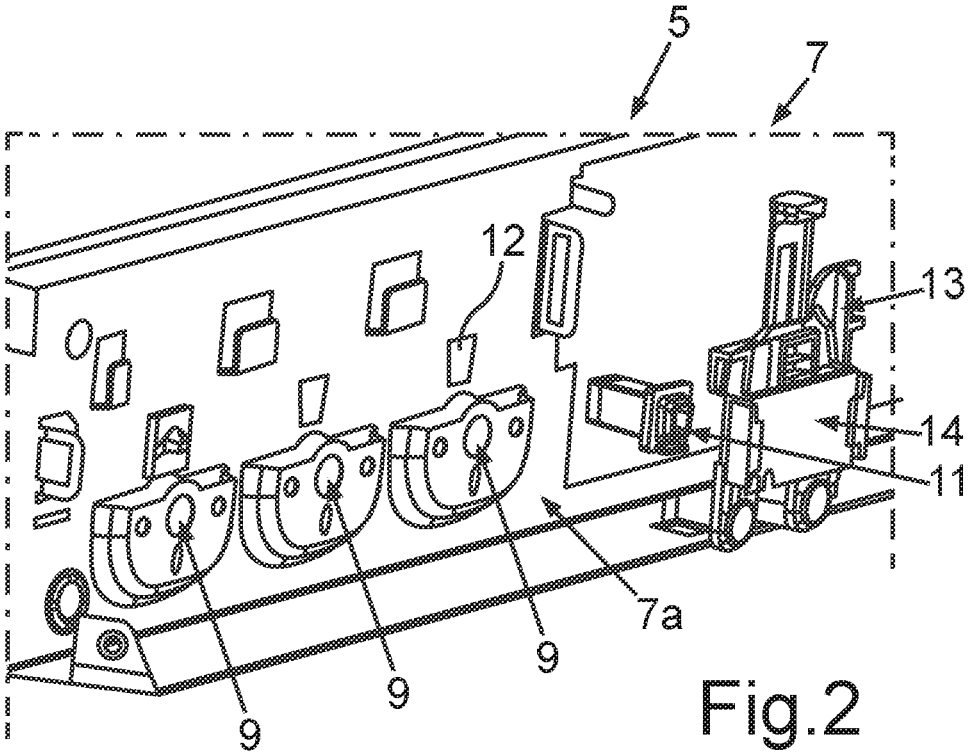
FIG. 2 shows a perspective view of subcomponents of an exemplary embodiment of an operator control apparatus according to the invention.

FIG. 2 shows a partial cut-out view of subcomponents of the operator control apparatus 5. In this context, the operator control apparatus 5 comprises a carrier plate 7 which, in particular, can be formed by a frontal control panel 8 shown in FIG. 1. However, the carrier plate 7 can also be a separate carrier plate arranged behind the control panel 8. The carrier plate 7 is designed to accommodate the operator control elements 6. To this end, it is provided that the carrier plate 7 has bushings 9 through which a pin having an axis of rotation can be guided, wherein the pin can be coupled in the housing 2 with an electronics assembly for detecting the rotational position. However, the rotational position can also be detected by way of a gear shift drum which closes or does not close a switch, after which the rotational position is detected from the switching position by means of a simple switching element.

Furthermore, an operator control element 6 also comprises a cap or a front cap 10 which is connected to said operator control element by the pin guided through the openings 9. This front cap 10 forms the front and frontal end of the operator control element 6 and can be accessed by a user in order to perform the rotational movement relative to the carrier plate 7.

Furthermore, the operator control apparatus 5 comprises a light guide, wherein an exemplary embodiment of a light guide 11 still separated from the carrier plate 7 is shown in FIG. 2. The carrier plate 7 comprises an opening 12 through which the light guide 11 extends in an assembled state and extends on both sides of the carrier plate 7. Furthermore, the operator control apparatus 5 comprises an adapter part 13 which is designed separately from the carrier plate 7 and separately from the light guide 11. The adapter part 13 comprises a plate 14 on which at least one light source, in particular a light-emitting diode, is assembled. The light which is emitted by this light source is then coupled into the light guide 11 and emitted from behind by the light guide 11 into the front cap 10 such that the interior of the front cap 10 is illuminated accordingly. The front cap 10 has, as will be explained below, at least one transparent region which is illuminated by the light emitted by the light guide 11.

Figure 3:
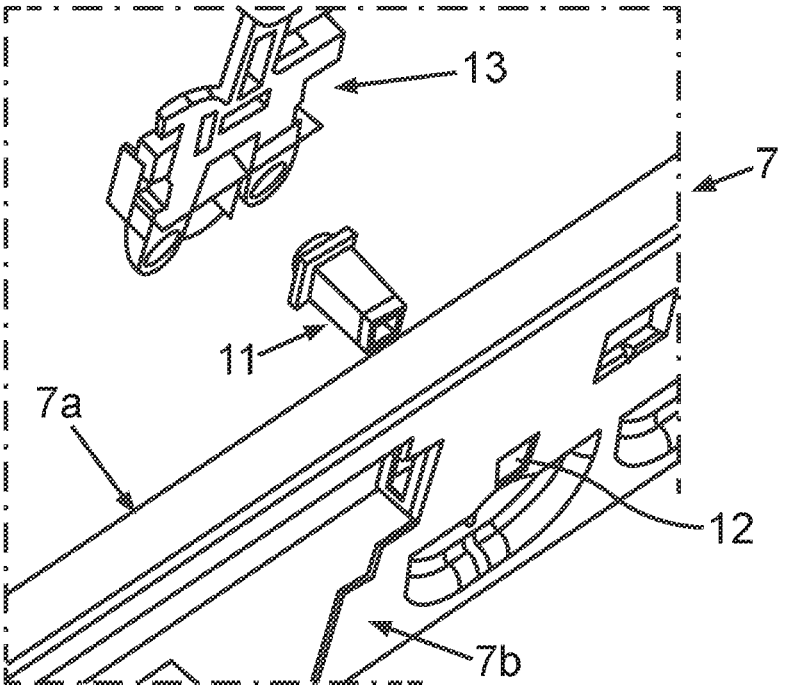
FIG. 3 shows a further perspective view of the components according to FIG. 2.

FIG. 3 shows the illustration of the components according to FIG. 2 in a different perspective. FIG. 2 shows the view of a reverse side 7*a* facing the housing interior. The illustration in FIG. 3, on the other hand, shows a view from obliquely above onto a front side 7*b* of the carrier plate 7. The front side 7*b* is facing a front cap 10.

Figure 4:
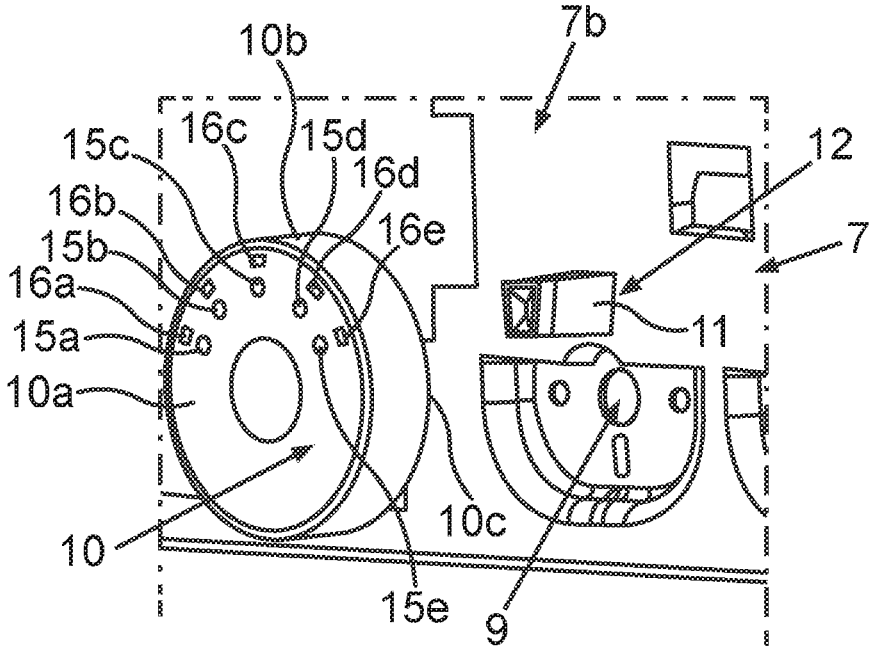
FIG. 4 shows a partial view in a further perspective of the embodiment according to FIG. 2 and FIG. 3.

FIG. 4 shows a further section in which the light guide 11 is illustrated in its position on the carrier plate 7 and in its position extending through the opening 12.

The front cap 10 is still shown in a disassembled state. As can be seen in FIG. 4, the front cap 10 is cylindrically designed and comprises a front wall 10*a* and a casing wall 10*b* by means of which a cavity of the front cap 10 open to the carrier plate 7 is delimited. In the exemplary embodiment, the front cap 10 comprises a plurality of transparent regions 15*a*, 15*b*, 15*c*, 15*d*, 15*e* in the front wall 10*a* which particularly show symbols of operating functions of the domestic appliance 1 and for example, are embodied in an arc at a distance from one another. In the exemplary embodiment, the operator control element 6 is therefore a function selector. A first transparent region is one of these regions 15*a* to 15*e*, whereas the others then each form the second transparent regions. In particular, this depends on the rotational position of the front cap 10 relative to the light guide 11 arranged in a fixed position on the carrier plate 7. The light guide 11 is arranged such that the region 15*a* to 15*e* which is arranged at a 12 o'clock position is always illuminated with coupled out light with a first light intensity. At least some of the other respective regions are then illuminated with a different darker second light intensity from the coupled-out light of the light guide 11. Further transparent regions 16*a*, 16*b*, 16*c*, 16*d*, 16*e* explained below and arranged in an arc are not present.

The front cap 10 is hollow in design on the side facing the light guide 11 and arranged without contacting the light guide 11 in an assembled state. The front cap 10 terminates with its end facing the carrier plate 7, which is formed by the edge of the casing wall 10*b* facing away from the front wall 10*a*, viewed in the direction of the axis of rotation in front of the carrier plate 7.

Figure 5:
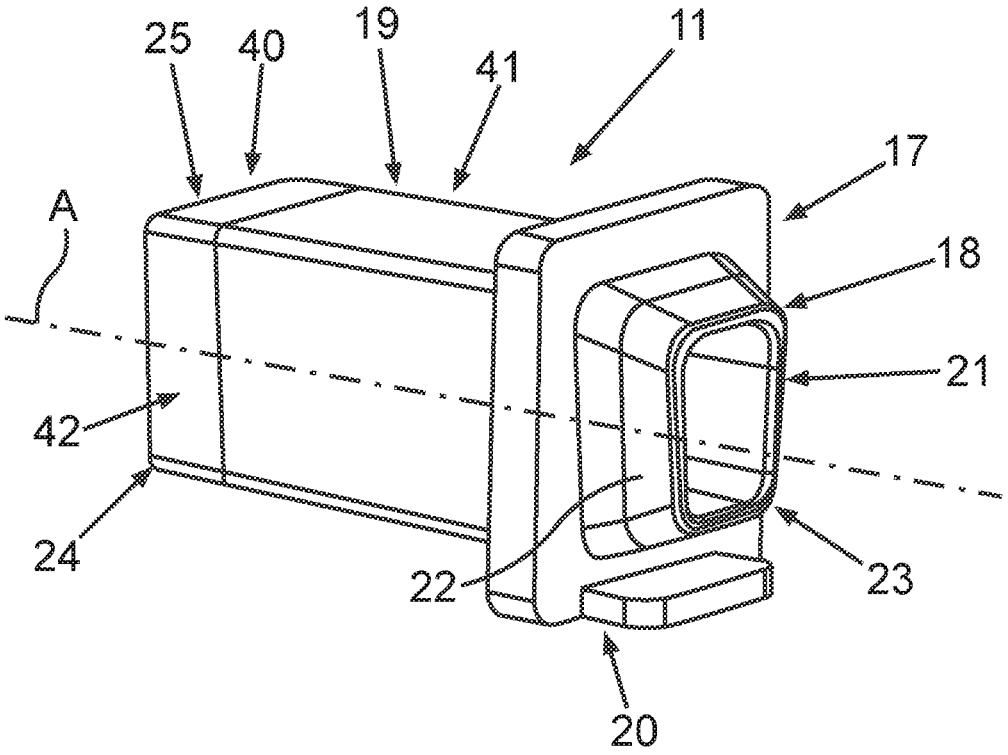
FIG. 5 shows a perspective view of a first exemplary embodiment of a light guide of the operator control apparatus.

In FIG. 5, the exemplary embodiment of the light guide 11 is shown in a first perspective view. The one-piece light guide 11 made of plastic, for example, PMMA or PC, comprises a contact flange 17 which extends on a plane and is completely circumferential in design. It has an angular, in particular rectangular, shape. The light guide 11 fits closely to the contact flange 17 in the interior or reverse side 7*a* of the carrier plate 7 in an assembled state. The light guide 11 comprises a first light guide section 18 and a second light guide section 19. These extend along a longitudinal axis A of the light guide 11 on opposite sides of the contact flange 17. A coupling element 20 arranged on a side of the contact flange 17 facing away from the second light guide section 19 is provided for coupling with the adapter part 13. This coupling element 20 is a plate-like support which extends perpendicular to the extension plane of the contact flange 17.

The first light guide section 18 is hollow in design over its entire length, viewed in the direction of the longitudinal axis A. The first light guide section 18 leads to the contact flange 17. Accordingly, the second light guide section 19 also leads to the contact flange 17. As is shown, the two light guide sections 18 and 19 are geometrically different to one another in design. Viewed in the direction of the axis A, the first light guide section 18 is shorter than the second light guide section 19. The first light guide section 18 has a trapezoidal inner contour 21 which extends on a plane perpendicular to the axis A. This trapezoidal inner contour 21 is preferably embodied over the entire length of the first light guide section 18.

Furthermore, viewed on a plane perpendicular to the axis A, the first light guide section 18 also has a trapezoidal outer contour 22. Preferably, this outer contour 22 is designed such that, viewed in the direction of the longitudinal axis A, it is conically widened from a coupling in end 23 to the contact flange 17.

Furthermore, it is provided that the second light guide section 19 is only hollow in some areas, viewed along the longitudinal axis A.

In particular, the second light guide section 19 is hollow in design, starting from an end leading to the contact flange 17 up to a coupling out structure 24. The coupling out structure 24 completes this hollow area on the side facing away from the contact flange 17 and thus a coupling out end 25. The second light guide section 19 comprises a first light coupling out region 39 and a second light coupling out region 40 in its coupling out structure 24.

Figure 6:
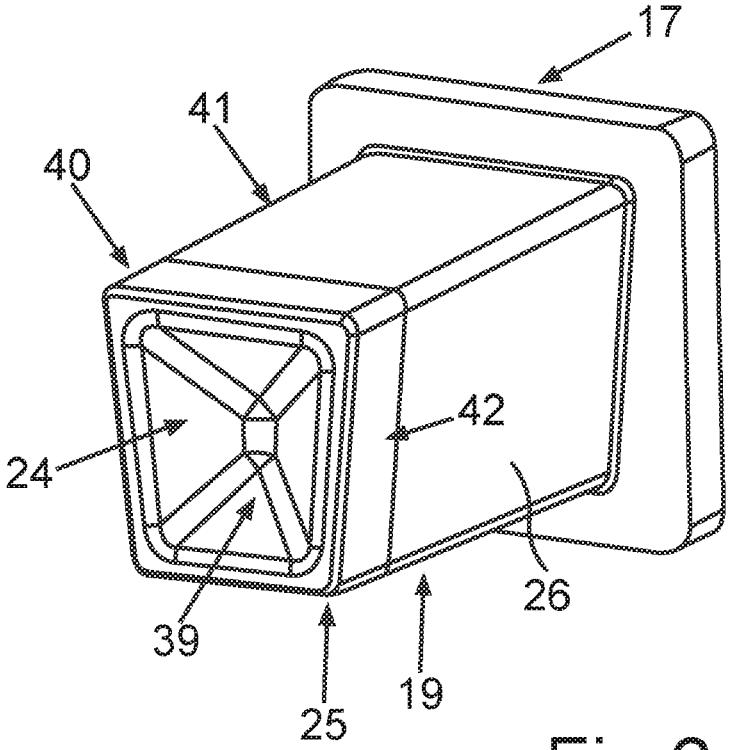
FIG. 6 shows a further perspective view of the light guide according to FIG. 5.

As shown in FIG. 6, the first light coupling out region 39 is designed as a polygonal structure, particularly with a pyramid shape. This polygonal structure is designed in the direction of the contact flange 17 and is thus inwardly oriented and thus not projecting forwards facing away from the contact flange 17.

Preferably, the second light guide section 19 also has a trapezoidal inner contour viewed on a sectional plane perpendicular to the longitudinal axis A. In particular, an outer contour 26 of the second light guide section 19 is also trapezoidal, viewed on a plane perpendicular to the longitudinal axis A, in particular over the entire length of the second light guide section 19.

Preferably, it is provided that the hollow area in the second light guide section 19, which has a trapezoidal inner contour on a plane perpendicular to the axis A, is of a tapered design starting from the contact flange 17 to the coupling-out structure 24.

The second light coupling out region 40 is designed as a scattered light zone 42 on a casing wall 41 of the second light guide section 19 on the coupling out end 25. The scattered light zone 42 is designed circumferentially in the form of a strip and thus encompasses the polygonal structure around the axis A circumferentially. The scattered light zone 42 has a different surface roughness in relation to the other surface areas, particularly a greater surface roughness. With the polygonal structure, particularly the first light intensity is generated and with the scattered light zone 42, the second light intensity is generated.

Figure 7:
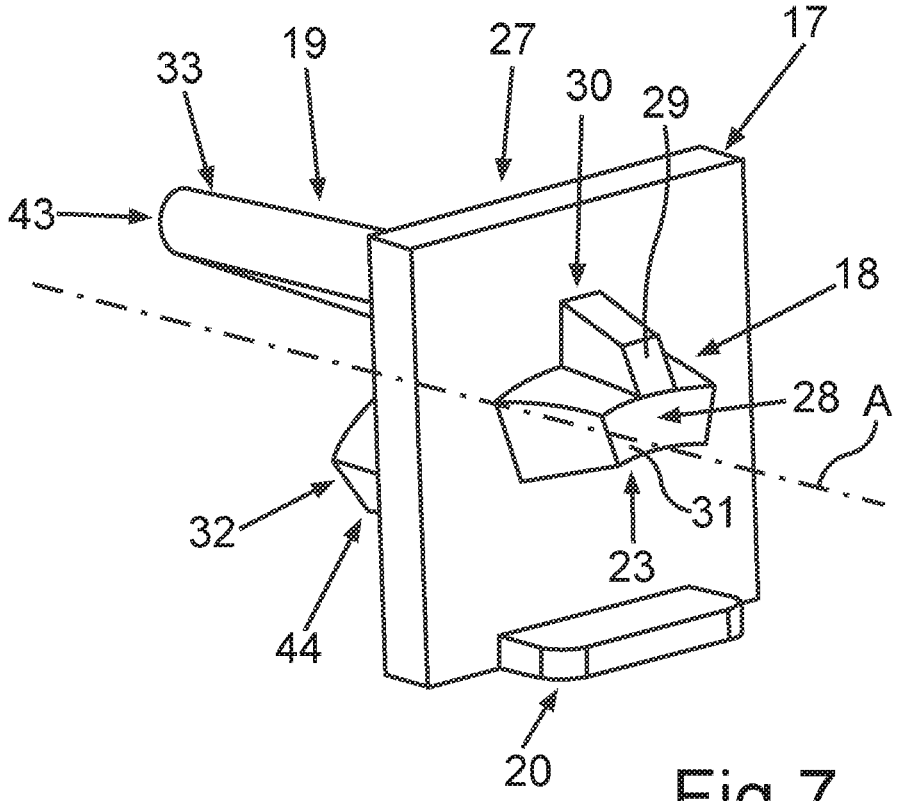
FIG. 7 shows a perspective view of a further exemplary embodiment of a light guide of the operator control apparatus.

FIG. 7 shows a perspective view of a further exemplary embodiment of a light guide 27 which is likewise designed in one piece and for example, of a plastic, particularly PMMA or PC. In this embodiment, the first light guide section 18 is T-shaped in design. A top 28 of the T-shape is curved in design. Furthermore, viewed in the direction of the longitudinal axis A, the T-shape is flared in design, viewed from a coupling in end 23 to the contact flange 17.

At the coupling in end 23 of the T-shape, a coupling in surface 29 of a base 30 of the T-shape spans a plane or extends on a plane which is at an angle to a plane on which a coupling in surface 31 of the top 28 extends. The two coupling in surfaces 29 and 31 therefore do not extend on a common plane. Furthermore, the coupling in surface 29 of the base 30 leads to the coupling in surface 31.

The second light guide section 19 comprises an annular section 32 and a pin 33 which in cross section is cylindrical or preferably angular, in particular rectangular. The annular section 32 forms a second light coupling out region 44, whereas the pin 33 forms a first light coupling out region 43.

Figure 8:
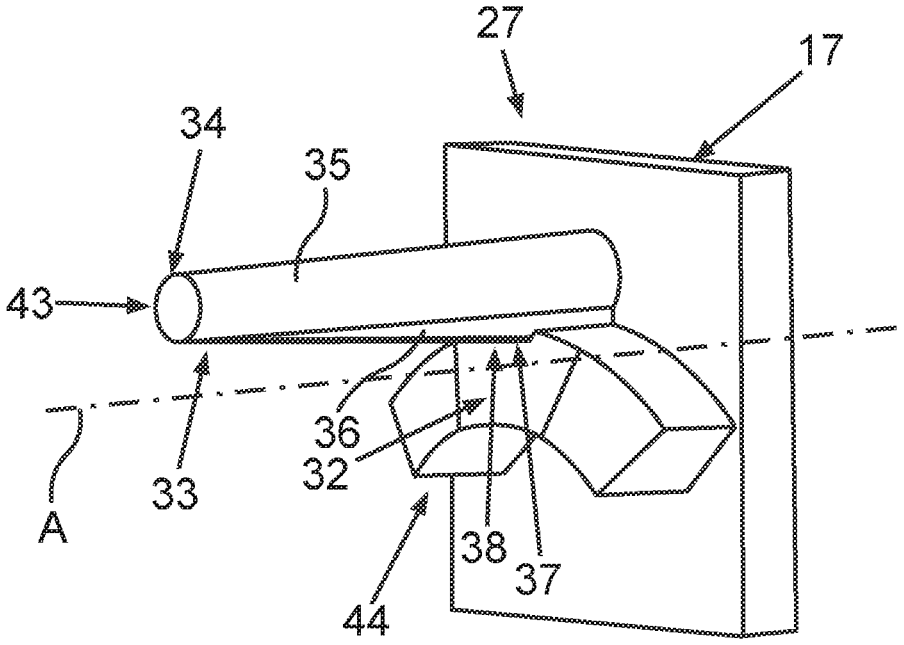
FIG. 8 shows a further perspective view of the light guide according to FIG. 7.

As can be seen in FIG. 8, in which a perspective of the light guide 27 different to FIG. 7 can be seen, viewed in the direction of the longitudinal axis A the pin 33 extends further than the annular section 32. Furthermore, starting from the contact flange 17 to a coupling out end 34, the cylindrical pin 33 is designed in a tapering manner. Furthermore, the pin 33 has a connecting region 36 integrally preformed on a casing wall 35 which engages in a receptacle 37 of the annular section 32. The receptacle 37 is designed on an arc maximum 38 of the annular section 32.

The light guide 27 is preferably present in an operator control element 6 in which the operator control element is designed as an operating parameter value selector, for example, as a temperature value selector. It can thus be provided that the first transparent regions 16*a*, 16*b*, 16*c*, 16*d* and 16*e* are then formed on a front wall 10*a* of the front cap 10, as is also shown in FIG. 4 by way of example. These are arranged in an arc or circle and embodied at a distance from one another. Furthermore, the second transparent regions 15*a*, 15*b*, 15*c*, 15*d* and 15*e* which are values of the temperature are embodied on the front wall 10*a*. A punctiform, bright illumination and thus an illumination with a first light intensity of a marking zone which is formed by a first transparent region 16*a* to 16*e* can now take place with the pin 33 and an associated value which is embodied on a smaller arc or circle on the front wall 10*a* is illuminated more dimly and thus with a lower light intensity with the annular section 32. Also, only one region 16*a* to 16*e* in particular is then brightly lit and the other first regions are illuminated more dimly for this purpose. The number of transparent regions 16*a* to 16*e* is preferably greater than the number of transparent regions 15*a* to 15*e*. Here too then, particularly the region of the transparent regions 16*a* to 16*e* in the 12 o'clock position is brightly lit.

In general and in a pan exemplary embodiment manner, a dynamic alteration of the illumination with different light intensities is also achieved by means of the relative rotatability of the front cap 10 to the light guide 11 or the light guide 27, which generates a dynamic "switching effect" of the illumination when considering the moved front cap 10, without the position of the light guide being changed or the light emission at the light source possibly changing, which simplifies the control of the light source as it is only activated.

Preferably, the surfaces of the light guide 11 or the light guide 27 into which the light is guided are burnished. It is preferably provided that the front cap 10 is designed from fiberglass material on an inner side 10*c* facing the light guide 11 or the light guide 27, at least in some areas.

Both embodiments of the light guide 11 or the light guide 27 are designed with the contact flange 17 such that this fits positively to the inner side or reverse side 7*a*.

The light intensity in the illumination of transparent regions of an operator control element can be varied individually and in a targeted manner and thus locally requested and defined by means of the light guide 11 and the light guide 27.

The invention claimed is:

1. An operator control apparatus for a domestic appliance, comprising:

a carrier plate;

an operator control element rotatably arranged on the carrier plate for setting an operating condition of the domestic appliance, said operator control element including a front cap comprising a first transparent region and a second transparent region which is separate from the first transparent region; and a light guide configured to extend into the front cap and to guide light from a light source such as to illuminate the first transparent region with a first light intensity of the light which is coupled out of the light guide, and to illuminate the second transparent region with a second light intensity of the light which is coupled out of the light guide, with the second light intensity of the light being different from the first light intensity, wherein the light guide extends through an opening into the carrier plate and includes an integrated contact flange which fits closely to an inner side of the carrier plate.

2. The operator control apparatus of claim 1, wherein the light guide includes a first light coupling out region for coupling out light for illumination of the first transparent region and a second light coupling out region for coupling out light for illumination of the second transparent region.

3. The operator control apparatus of claim 2, wherein the first light coupling out region and the second light coupling out region are formed in one piece.

4. The operator control apparatus of claim 1, wherein the light guide is formed separately from the front cap and has an end which faces the first and second transparent regions of the front cap at a distance thereto.

5. The operator control apparatus of claim 1, wherein the light guide includes first and second light guide sections extending in a direction of a longitudinal axis of the light guide on both sides of the contact flange, respectively.

6. The operator control apparatus of claim 5, wherein the first light guide section forms an irradiation section and leads to the contact flange, and the second light guide section forms a radiation section and leads to the contact flange and has light coupling out regions for generation of coupled out light with different light intensities, with the first light guide section being configured geometrically different to the second light guide section.

7. The operator control apparatus of claim 5, wherein the first light guide section is hollow and open on both sides viewed in the direction of the longitudinal axis of the light guide, and the second light guide section is hollow in at least one area.

8. The operator control apparatus of claim 5, wherein the first light guide section has a trapezoidal inner contour and/or a trapezoidal outer contour in a sectional plane viewed perpendicular to the longitudinal axis.

9. The operator control apparatus of claim 5, wherein the light guide includes a first light coupling out region for coupling out light for illumination of the first transparent region, and a second light coupling out region for coupling out light for illumination of the second transparent region, said second light guide section being closed on a coupling out end facing away from the contact flange and including a coupling out structure comprising the first light coupling out region and the second light coupling out region.

10. The operator control apparatus of claim 9, wherein the first light coupling out region is a polygonal structure that is inwardly oriented in a direction of the first light guide section, and the second light coupling out region is a scattered light zone on a casing side of the second light guide section which encompasses at least one area of the polygonal structure.

11. The operator control apparatus of claim 9, wherein the first light coupling out region has a pyramid shape.

12. The operator control apparatus of claim 9, wherein the second light guide section has a trapezoidal configuration.

13. The operator control apparatus of claim 5, wherein the first light guide section has a T-shaped configuration.

14. The operator control apparatus of claim 5, wherein the second light guide section has an annular section as a second light coupling out region and a pin which is cylindrical or angular in cross-section as a first light coupling out region.

15. The operator control apparatus of claim 14, wherein the pin has in the direction of the longitudinal axis a length which is longer than a length of the annular section.

16. A domestic appliance, comprising an operator control apparatus, said operator control apparatus comprising a carrier plate, an operator control element rotatably arranged on the carrier plate for setting an operating condition of the domestic appliance, said operator control element including a front cap comprising a first transparent region and a second transparent region which is separate from the first transparent region, and a light guide configured to extend into the front cap and to guide light from a light source such as to illuminate the first transparent region with a first light intensity of the light which is coupled out of the light guide, and to illuminate the second transparent region with a second light intensity of the light which is coupled out of the light guide, with the second light intensity of the light being different from the first light intensity, wherein the light guide extends through an opening into the carrier plate and includes an integrated contact flange which fits closely to an inner side of the carrier plate.

* * * * *